United States Patent [19]

Malhotra

[11] Patent Number: 4,865,914

[45] **Date of Patent: * Sep. 12, 1989**

[54] TRANSPARENCY AND PAPER COATINGS

[75] Inventor: Shadi L. Malhotra, Mississauga, Canada

[73] Assignee: Xerox Corporation, Stamford, Conn.

[ * ] Notice: The portion of the term of this patent subsequent to Jun. 3, 2003 has been disclaimed.

[21] Appl. No.: 28,373

[22] Filed: Mar. 20, 1987

[51] Int. Cl.[4] ..... B41M 5/00

[52] U.S. Cl. ..... 428/331; 346/1.1; 346/135.1; 428/195; 428/336; 428/481; 428/483; 428/507; 428/508; 428/509; 428/516; 428/517; 428/518; 428/532; 428/534; 428/536; 428/537.5

[58] Field of Search ..... 346/1.1, 135.1; 428/195, 481, 483, 507, 508, 509, 516–518, 532, 534, 536, 332, 336, 537.5

[56] References Cited

U.S. PATENT DOCUMENTS

| | | | |
|---|---|---|---|
| 3,306,863 | 2/1967 | Leitner | 260/8 |
| 3,988,160 | 10/1976 | Trexel | 106/1 |
| 4,169,818 | 10/1979 | DeMartino | 260/17 R |
| 4,371,582 | 2/1983 | Sugiyama et al. | 428/341 |
| 4,415,683 | 11/1983 | Kernstock | 524/43 |
| 4,446,174 | 5/1984 | Maekawa et al. | 427/261 |
| 4,474,850 | 10/1984 | Burwasser | 428/336 |
| 4,503,111 | 3/1985 | Jaeger et al. | 428/195 |
| 4,507,413 | 3/1985 | Thoma et al. | 524/42 |
| 4,547,405 | 10/1985 | Bedell et a l. | 427/256 |
| 4,554,181 | 11/1985 | Cousin et al. | 408/207 |
| 4,590,227 | 5/1986 | Nakamura et al. | 523/130 |
| 4,592,954 | 6/1986 | Malhorta | 428/335 |
| 4,623,689 | 11/1986 | Shintani et al. | 524/457 |
| 4,657,557 | 4/1987 | Niwa et al. | 428/532 |

*Primary Examiner*—George F. Lesmes
*Assistant Examiner*—J. B. Monroe
*Attorney, Agent, or Firm*—E. O. Palazzo; J. L. Byorick

[57] ABSTRACT

A transparency comprised of a supporting substrate and thereover a blend comprised of poly(ethylene oxide), and carboxy methyl cellulose together with a component selected from the group consisting of (1) hydroxypropyl cellulose; (2) vinylmethyl ether/maleic acid copolymer; (3) carboxymethyl hydroxyethyl cellulose; (4) hydroxyethyl celluose; (5) acrylamide/acrylic acid copolymer; (6) cellulose sulfate; (7) poly(2-acrylamido-2-methyl propane sulfonic acid); (8) poly(vinyl alcohol); (9) poly(vinyl pyrrolidone); and (10) hydroxypropyl methyl cellulose. In addition, papers with the aforementioned coatings are disclosed herein.

25 Claims, No Drawings

TRANSPARENCY AND PAPER COATINGS

BACKGROUND OF THE INVENTION

This invention relates generally to transparencies, and more specifically the present invention is directed to transparencies with certain coatings thereover and the use of these transparencies in ink jet printing processes. Thus, in one embodiment, the present invention relates to transparencies comprised of a supporting substrate with certain coatings thereover as illustrated herein, which transparencies are particularly useful in ink jet printing processes. Additionally, in another embodiment of the present invention there are provided papers for ink jet printing, which papers contain thereover the coatings illustrated hereinafter with colloidal silica dispersed therein in, for example, an amount of from about 40 to about 60 percent by weight. Accordingly, the coated paper substrates of the present invention may also be incorporated into electrostatographic imaging processes.

Ink jet printing systems are well known. Thus, for example, there is described in U.S. Pat. No. 3,846,141 a composition for ink jet printing comprised of an aqueous solution of a water soluble dye and a humectant material formed of a mixture of a lower alkoxy triglycol, and at least one other compound selected from the group consisting of a polyethylene glycol, a lower alkyl ether of diethylene glycol, and glycerol. According to the disclosure of this patent, the viscosity of the printing inks is subjected to little variation with use in that water is lost by evaporation during recirculation of the ink composition through the jet printer. Moreover, apparently the humectant system disclosed in this patent substantially prevents or minimizes tip drying of the printing ink in the orifice or nozzle during down time of the printer such as when the printer is rendered inoperative. As further disclosed in the patent, the basic imaging technique in jet printing involves the use of one or more ink jet assemblies connected to a pressurized source of ink. Each individual ink jet includes a very small orifice usually of a diameter of 0.0024 inch, which is energized by magneto restrictive piezoelectric means for the purpose of emitting a continuous stream of uniform droplets of ink at a rate of 33 to 75 kilohertz. This stream of droplets is desirably directed onto the surface of a moving web of, for example, paper and is controlled to form printed characters in response to video signals derived from an electronic character generator and in response to an electrostatic deflection system.

Also, there are disclosed in U.S. Pat. No. 4,279,653 ink jet compositions containing water soluble wetting agents, a water soluble dye and an oxygen absorber. Similarly, U.S. Pat. No. 4,196,007 describes an ink jet printing composition containing an aqueous solution of water soluble dye and a humectant consisting of at least one water soluble unsaturated compound. Other patents disclosing aqueous inks for ink jet printing include U.S. Pat. Nos. 4,101,329; 4,290,072; and 4,299,630.

Ink jet recording methods and ink jet transparencies using the above-mentioned or similar inks are well known. There is disclosed in U.S. Pat. No. 4,446,174 an ink jet recording method for producing a recorded image on an image receiving sheet with aqueous inks, and wherein an ink jet is projected onto an image receiving sheet comprising a surface layer containing a pigment, which surface layer is capable of absorbing a coloring component present in the aqueous ink. Also, there is disclosed in U.S. Pat. No. 4,371,582 an ink jet recording sheet containing a latex polymer, which can provided images having excellent water resistance properties and high image density by jetting them onto an aqueous ink containing a water soluble dye. Similarly, U.S. Pat. No. 4,547,405 describes an ink jet recording sheet comprising a transparent support with a layer comprising 5 to 100 percent by weight of a coalesced block copolymer latex of poly (vinyl alcohol) with polyvinyl(benzyl ammonium chloride), and 0 to 95 percent by weight of a water soluble polymer selected from the group consisting of poly(vinyl alcohol),poly(-vinyl pyrrolidone),and copolymers thereof.

Other coatings for ink jet transparencies include blends of carboxylated polymers with poly(alkylene glycol), reference U.S. Pat. No. 4,474,850; blends of poly(vinyl pyrrolidone) with matrix forming polymers such as gelatin; or poly(vinyl alcohol), swellable by water and insoluble at room temperature but soluble at elevated temperatures, reference U.S. Pat. No. 4,503,111; and blends of poly(ethylene oxide) with carboxymethyl cellulose as illustrated in U.S. Pat. No. 4,592,954, the disclosure of which is totally incorporated herein by reference.

Although the transparencies illustrated in the prior art are suitable for their intended purposes, there remains a need for other transparencies with new coatings thereover that are useful in ink jet printing processes, and that will enable the formulation of images with high optical densities. Additionally, there is a need for transparencies with a blend of coatings thereover that are compatible with ink jet compositions, particularly those derivable from ethylene glycol/water components. There is also a need for coated papers that are useful in electrostatographic imaging processes wherein images with excellent resolution and no background deposits are obtained. Another need of the present invention resides in providing transparencies with a blend of coatings that do not block (stick) at, for example, 50 percent relative humidity and at a temperature of 50° C.

SUMMARY OF THE INVENTION

It is an object of the present invention to provide transparencies with the above-noted advantages.

Another object of the present invention resides in the provision of ink jet transparencies with certain coatings thereover.

Also, in another object of the present invention there are provided transparencies with certain coatings thereover thus enabling images with high optical densities.

Another object of the present invention resides in ink jet transparencies that permit the substantial elimination of beading caused by poor inter-drop coalescence during mixing of the primary colors to generate secondary color such as, for example, mixtures of cyan and yellow enabling green colors.

Furthermore, in another object of the present invention there are provided ink jet transparencies that enable elimination of bleeding of colors due to intermingling or diffusion of dyes when different colors, for example black, are printed together with another color like magenta.

Moreover, another object of the present invention resides in ink jet transparencies that have substantial permanence for extended time periods.

Additionally, another object of the present invention relates to ink jet transparencies with a coating comprised of three components thereover.

Another object of the present invention relates to transparencies with specific coatings which enable water and glycol absorption from the inks selected in a rapid manner thereby enabling such coatings to be particularly useful in known ink jet printers.

In yet another object of the present invention there are provided coatings which are compatible with filled papers, sized papers and opaque Mylars, and which coatings will enable the aforementioned substrates to generate high optical density images with ink jet processes.

In still another object of the present invention there are provided polymer coatings for other substrates including paper products, which coatings enable an increase in the shelf life of the resulting products permitting their usefulness in various printers subsequent to extended storage, for example, in excess of six months in unsealed envelopes.

These and other objects of the present invention are accomplished by providing transparencies and papers with coatings thereover. More specifically, in accordance with one embodiment of the present invention there are provided ink jet transparencies and ink jet papers with coatings thereover which are compatible with the inks selected for marking, and wherein the coatings enable acceptable optical density images to be obtained. More specifically, in one embodiment of the present invention there are provided ink jet transparencies comprised of a supporting substrate, and a coating thereover comprised of a ternary mixture of hydroxypropyl cellulose, carboxymethyl cellulose, and poly(ethylene oxide). Moreover, in another specific embodiment of the present invention there are provided coatings for ink jet paper comprised of a supporting substrate, and thereover a quaternary mixture of hydroxy propyl cellulose, carboxymethyl cellulose, poly(ethylene oxide), and colloidal silica.

A specific embodiment of the present invention is directed to a transparency comprised of a supporting substrate, and thereover a blend comprised of poly(ethylene oxide), and carboxymethyl cellulose together with a component selected from the group consisting of (1) hydroxypropyl cellulose; (2) vinylmethyl ether/maleic acid copolymer; (3) carboxymethyl hydroxyethyl cellulose; (4) hydroxyethyl cellulose; (5) acrylamide/acrylic acid copolymer; (6) cellulose sulfate; (7) poly(2-acrylamido-2-methyl propane sulfonic acid; (8) poly(vinyl alcohol); (9) poly(vinyl pyrrolidone); and (10) hydroxypropyl methyl cellulose. Additionally, the present invention is directed to ink jet papers comprised of a supporting substrate, and thereover a blend comprised of poly(ethylene oxide), and carboxymethyl cellulose together with a component selected from the group consisting of (1) hydroxypropyl cellulose; (2) vinylmethyl ether/maleic acid copolymer; (3) carboxymethyl hydroxyethyl cellulose; (4) hydroxyethyl cellulose; (5) acrylamide/acrylic acid copolymer; (6) cellulose sulfate; (7) poly(2-acrylamido-2-methyl propane sulfonic acid; (8) poly(vinyl alcohol); (9) poly(vinyl pyrrolidone); and (10) hydroxypropyl methyl cellulose, which coating has dispersed therein additives such as colloidal silicas in an amount of from about 35 to about 65 percent by weight.

Illustrative examples of substrates with a thickness of from about 50 microns to about 125 microns, and preferably of a thickness of from about 100 microns to about 125 microns that may be selected for the ink jet transparencies include Mylar, commercially available from E. I. DuPont; Melinex, commercially available from Imperials Chemical, Inc.; Celanar, commercially available from Celanese; polycarbonates, especially Lexan; polysulfones; cellulose triacetate; polyvinylchlorides; and the like, with Mylar being particularly preferred in view of its availability and lower costs.

Examples of coatings that may be selected for the ink jet transparency substrates or for the ink jet papers include blends of (1) poly(ethylene oxide), hydroxypropyl cellulose, and carboxymethyl cellulose; (2) poly(ethylene oxide), hydroxyethyl cellulose, and carboxymethyl cellulose; (3) poly(ethylene oxide) with vinylmethyl ether/maleic acid copolymer and carboxymethyl cellulose; (4) hydroxypropyl methyl cellulose, carboxymethyl cellulose, and polyethylene oxide. Particularly preferred are blends of hydroxypropyl cellulose, carboxymethyl cellulose and poly(ethylene oxide); and the other blends illustrated herein. The aforementioned blends are selected in various effective percentages depending, for example, on the composition of the supporting substrate. Thus, for example, with a blend of hydroxypropyl cellulose, carboxymethyl cellulose and poly(ethylene oxide), or other blends there can be selected from about 5 percent by weight to about 20 percent by weight of hydroxypropyl cellulose, about 30 percent by weight to about 70 percent by weight of carboxymethyl cellulose and about 25 percent by weight to about 60 percent by weight of poly(ethylene oxide).

Specific coatings selected for the present invention include blends of carboxymethyl cellulose (CMC), Type 7HOF, available from Hercules Chemical Company, 45 percent by weight, poly(ethylene oxide) with a molecular weight of $4.0\times10^5$ available as POLY OX WSRN-3000, from Union Carbide, 45 percent by weight, and hydroxypropyl cellulose with a molecular weight of $6.0\times10^4$ available as KLUCEL, Type E, from Hercules Chemical Company, 10 percent by weight; blends of hydroxyethyl cellulose (NATROSOL 250LR, Hercules) 40 percent by weight, carboxymethyl cellulose (CMC 7HOF) 30 percent by weight and poly(ethylene oxide) (POLY OX WSRN-3000) 30 percent by weight; blends of carboxymethyl cellulose (CMC 7HOF) 20 percent by weight, vinyl methyl ether/maleic acid copolymer (GAF Corp. GANTREZ S-95) 20 percent by weight; and poly(ethylene oxide) (POLY OX WSRN-3000) 60 percent by weight, blends of carboxymethyl hydroxyethyl cellulose (Type 37L, Hercules) 40 percent by weight, carboxymethyl cellulose 20 percent by weight, and poly(ethylene oxide) (POLY OX WSRN-3000) 40 percent by weight; blends of poly(ethylene oxide) 45 percent by weight, poly(vinyl alcohol) (Scientific Polymer Products) 10 percent by weight, carboxymethyl cellulose 45 percent by weight; blends of poly(ethylene oxide) 45 percent by weight, carboxymethyl cellulose 45 percent by weight and poly(vinyl pyrrolidone) (Scientific Polymer Products) 10 percent by weight; blends of poly(ethylene oxide) 45 percent by weight, carboxymethyl cellulose 45 percent by weight and hydroxypropyl methyl cellulose (Methocel K35LV and J5MS, Dow Chemicals) 10 percent by weight; blends of poly(ethylene oxide) 45 percent by weight, carboxymethyl cellulose 45 percent by weight, hydroxypropyl cellulose 10 percent by weight with colloidal silica available as Syloid 74 from W. R. Grace Company. The amount of colloidal silica in the aforementioned blend is about 60 percent by weight.

The aforementioned polymer coatings can be present on the supporting substrates, such as Mylar, of paper in various thicknesses depending on the coatings selected and the other components utilized; however, generally the total thickness of the polymer blend coatings is from about 5 to about 25 microns, and preferably from about 7 to about 15 microns. Moreover, these coatings can be applied by a number of known techniques including reverse roll, extrusion and dip coating processes. In dip coating, a web of material to be coated is transported below the surface of the coating material by a single roll in such a manner that the exposed site is saturated, followed by the removal of any excess by a blade, bar or squeeze rolls. With reverse roll coating, the premetered material is transferred from a steel applicator roll to the web material moving in the opposite direction on a backing roll. Metering is performed in the gap precision-ground chilled iron rolls. The metering roll is stationary or is rotating slowly in the opposite direction of the applicator roll. Also, in slot extrusion coating there is selected a flat die to apply coating materials with the die lips in close proximity to the web of material to be coated. Once the desired amount of coating has been applied to the web, the coating is dried at 50° to 70° C. in air dryer.

Moreover, in one specific process embodiment, the ink jet transparencies of the present invention are prepared by providing a Mylar substrate in a thickness of from about 100 to about 125 microns; and applying to each side of the Mylar by dip coating processes, in a thickness of from about 7 to 12 microns, a polymer blend mixture comprised of 10 percent by weight of hydroxypropyl cellulose, 45 percent by weight of carboxymethyl cellulose, and 45 percent by weight of poly(ethylene oxide). Coating is affected from a solution blend of water, for example, about 80 percent, and ethanol or other aliphatic alcohol, about 20 percent by weight, having incorporated therein the polymer blend mixture. Thereafter, the coating is air dried and the resulting transparency with a paper backing can be utilized in a printer, such as the Xerox Corporation 4020R.

With the coatings of the present invention, there is enabled a prolongation of the shelf life of ink jet transparencies thereby permitting high optical density images subsequent to extended storage periods. Also, the coatings of the present invention enable a homogeneous spread of dyes in the inks thereby permitting images of optical densities, for example, of 1.35 (magenta), 1.03 (cyan), 0.62 (yellow) and 1.05 (black) in the transmission mode. In contrast, many of the coated transparencies commercially available, such as T-120 from Minnesota, Minning, and Manufacturing, the dye cannot be evenly spread causing bleeding and mottling, thus the resulting dried images usually are of a lower optical density, such as 0.76 for magenta; 0.73 for cyan; 0.44 for yellow; and 0.78 for black.

The optical density measurements recited herein, including the working Examples, were obtained on a Pacific Spectrograph Color System. The system consists of two major components: an optical sensor and a data terminal. The optical sensor employs a 6 inch integrating sphere to provide diffuse illumination and 8 degrees viewing. This sensor can be used to measure both transmission and reflectance samples. When reflectance samples are measured, a specular component may be included. A high resolution, full dispersion, grating monochromator was used to scan the spectrum from 380 to 720 nanometers. The data terminal features a 12 inch CRT display, numerical keyboard for selection of operating parameters, and the entry of tristimulus values; and an alphanumeric keyboard for entry of product standard information.

The following examples are being supplied to further define specific embodiments of the present invention, it being noted that these examples are intended to illustrate and not limit the scope of the present invention. Parts and percentages are by weight unless otherwise indicated.

EXAMPLE I

There was prepared coated transparency Mylar sheets of a thickness of 125 microns by affecting a dip coating of these sheets into a 40 percent by weight blend of poly(ethylene oxide), 45 percent by weight; carboxymethyl cellulose, 45 percent by weight; and hydroxypropyl cellulose, 10 percent by weight, which blend was present in a concentration of 3 percent by weight in water. Subsequent to air drying and monitoring the differences in weight prior to and subsequent to coating, the coated sheets had present on each side 500 milligrams, 6 microns in thickness, of the polymer blend. These sheets were then fed individually into a Xerox Corporation 4020R ink jet color printer, having incorporated therein four separate developer inks comprised of water, glycols, and magenta, cyan, yellow or black dyes, respectively; and there were obtained images with optical densities of 1.35 (magenta), 1.03 (cyan), 0.62 (yellow) and 1.05 (black). The aforementioned inks are commercially available from Sharp, Inc.

EXAMPLE II

There was prepared a coated ink jet paper by applying a coating to a roll of 90 micron thick Diazo paper on a Faustel Coater using reverse-roll processes. The constituents of the coating were comprised of a 40 percent by weight blend of carboxymethyl cellulose, 45 percent by weight; poly(ethylene oxide), 45 percent by weight; and hydroxypropyl cellulose, 10 percent by weight; and synthetic colloidal silica 60 percent by weight, which blend was present in a concentration of 5 percent by weight in water. Subsequent to drying at 75° C. and monitoring the differences in weight prior to and subsequent to coating, the coated paper had present 8 grams/meter squared of polymer and silica blend on the coated side in a thickness of 22 microns. The coated paper was then cut into sheets and fed into a Xerox Corporation 4020R ink jet color printer as detailed in Example I. There were obtained images with optical densities of 1.85 (black), 1.57 (magenta), 1.75 (cyan) and 0.99 (yellow). In contrast, images prepared in the same manner on the commercially available (Diablo 3R2903) clay coated papers had optical density values of 1.87 (black), 1.6 (magenta), 1.5 (cyan) and 0.90 (yellow).

Example III

There was prepared a coated no-tear paper (titanium dioxide coated plastic sheet) of thickness of 70 microns by affecting a dip coating with a 60 percent by weight blend of carboxymethyl cellulose, 45 percent by weight; poly(ethylene oxide), 45 percent by weight; and hydroxy propyl cellulose, 10 percent by weight; and 40 percent by weight of colloidal silica, which blend was present in a concentration of 5 percent by weight in water. Subsequent to air drying at room temperature and monitoring the differences in weight prior to and subsequent to coating, the coated no-tear paper had present 5 grams/meter squared of polymer and silica blend, 13 microns thick, on each side of the sheet. These sheets were then fed into a Xerox Corporation 4020R color ink jet printer by repeating the procedure of Example I, and images with optical densities of 1.42 (black), 1.35 (magenta), 1.38 (cyan) and 0.95 (yellow) were obtained.

Coated no-tear papers of the present invention were also fed into a Radio Shack CGP-220 color ink jet printer by repeating the above procedure, and images with optical densities of 0.5 (black), 0.60 (magenta), 0.61 (cyan) and 0.41 (yellow) were obtained. In contrast, images prepared in the same manner on the commercially available IBM 6293884 coated paper had optical density values of 0.6 (black), 0.62 (magenta), 0.71 (cyan) and 0.46 (yellow).

Other modifications of the present invention will occur to those skilled in the art based upon a reading of the present disclosure. These are intended to be included within the scope of this invention.

What is claimed is:

1. A transparency comprised of a supporting substrate and thereover a blend consisting essentially of poly(ethylene oxide), and carboxymethyl cellulose together with a component selected from the group consisting of (1) hydroxypropyl cellulose; (2) vinylmethyl ether/maleic acid copolymer; (3) carboxymethyl hydroxyethyl cellulose; (4) hydroxyethyl cellulose; (5) acrylamide/acrylic acid copolymer; (6) cellulose sulfate; (7) poly(2-acrylamido-2-methyl propane sulfonic acid); (8) poly(vinyl alcohol); (9) poly(vinyl pyrrolidone); and (10) hydroxypropyl methyl cellulose.

2. A transparency in accordance with claim 1 wherein the coating consists essentially of about 60 percent by weight of carboxymethyl cellulose, about 35 percent by weight of polyethylene oxide, and about 5 percent by weight of hydroxypropyl cellulose.

3. A transparency in accordance with claim 1 wherein the coating blend consists essentially of from about 5 to about 20 percent by weight of hydroxypropyl cellulose, from about 30 to about 70 percent by weight of carboxymethyl cellulose, and from about 25 to about 60 percent by weight of poly(ethylene oxide).

4. A transparency in accordance with claim 1 wherein the coating blend consists essentially of from about 5 to about 40 percent by weight of hydroxyethyl cellulose, from about 20 to about 70 percent by weight of carboxymethyl cellulose, and from about 25 to about 60 percent by weight of poly(ethylene oxide).

5. A transparency in accordance with claim 1 wherein the coating blend consists essentially of from about 5 to about 50 percent by weight of carboxymethyl cellulose, from about 10 to about 50 percent by weight of vinylmethyl ether/maleic acid copolymer, and from about 20 to about 70 percent by weight of poly(ethylene oxide).

6. A transparency in accordance with claim 1 wherein the coating blend consists essentially of from about 5 to about 50 percent by weight of carboxymethyl cellulose, from about 10 to about 50 percent by weight of acrylamide/acrylic acid copolymer, and from about 20 to about 70 percent by weight of poly(ethylene oxide).

7. A transparency in accordance with claim 1 wherein the coating blend consists essentially of from about 5 to about 50 percent by weight of carboxymethyl cellulose, from about 10 to about 50 percent by weight of cellulose sulfate, and from about 20 to about 70 percent by weight of poly(ethylene oxide).

8. A transparency in accordance with claim 1 wherein the coating blend consists essentially of from about 5 to about 50 percent by weight of carboxymethyl cellulose, from about 10 to about 50 percent by weight of poly(2-acrylamido-2-methyl propane sulfonic acid), and from about 20 to about 70 percent by weight of poly(ethylene oxide).

9. A transparency in accordance with claim 1 wherein the coating blend consists essentially of from about 2 to about 20 percent by weight of poly(vinyl pyrrolidone), from about 10 to about 75 percent by weight of carboxymethyl cellulose, and from about 20 to about 70 percent by weight of poly(ethylene oxide).

10. A transparency in accordance with claim 1 wherein the coating blend consists essentially of from about 5 to about 20 percent by weight of poly(vinyl alcohol), from about 10 to about 50 percent by weight of carboxymethyl cellulose, and from about 20 to about 60 percent by weight of poly(ethylene oxide).

11. A transparency in accordance with claim 1 wherein the coating blend consists essentially of from about 5 to about 50 percent by weight of carboxymethyl hydroxyethyl cellulose, from about 10 to about 50 percent carboxymethyl cellulose, and from about 20 to about 50 percent by weight of poly(ethylene oxide).

12. A transparency in accordance with claim 1 wherein the coating blend consists essentially of from about 5 to about 50 percent by weight of hydroxypropyl methyl cellulose, from about 10 to about 50 percent by weight of carboxymethyl cellulose, and from about 20 to about 50 percent by weight of poly(ethylene oxide).

13. A transparency in accordance with claim 1 wherein the supporting substrate is selected from the group consisting of poly(ethylene terephthalate), cellulose acetate, cellophane, polysulfone, polyvinyl chloride, and polypropylene.

14. A transparency in accordance with claim 1 wherein the supporting substrate is poly(ethylene terephthalate).

15. A transparency in accordance with claim 1 wherein the supporting substrate is coated from the polymer blend dissolved in a mixture of water and an aliphatic alcohol.

16. A transparency in accordance with claim 1 wherein the coating blend consists essentially of from about 5 percent by weight to about 20 percent by weight of hydroxypropyl cellulose, from about 30 percent by weight to about 70 percent by weight of carboxymethyl cellulose, and from about 25 percent by weight to about 60 percent by weight of polyethylene oxide.

17. An ink jet paper comprised of a supporting substrate and thereover a blend consisting essentially of poly(ethylene oxide), and carboxymethyl cellulose together with a component selected from the group consisting of (1) hydroxypropyl cellulose; (2) vinylmethyl ether/maleic acid copolymer; (3) carboxymethyl hydroxyethyl cellulose; (4) hydroxyethyl cellulose; (5) acrylamide/acrylic acid copolymer; (6) cellulose sulfate; (7) poly(2-acrylamido-2-methyl propane sulfonic acid); (8) poly(vinyl alcohol); (9) poly(vinyl pyrrolidone); and (10) hydroxypropyl methyl cellulose; and dispersed in the blend colloidal silica.

18. An ink jet paper in accordance with claim 17 wherein the supporting substrate is selected from the group consisting of titanium dioxide coated plastics, sized papers, and filled papers.

19. An ink jet paper in accordance with claim 17 wherein the coating blend consists essentially of from about 40 to about 60 percent by weight of polymer blend comprised of from about 40 to about 80 percent by weight of poly(ethylene oxide), about 10 to about 50 percent by weight of carboxypropyl cellulose; and about 2 to about 20 percent by weight of hydroxypropyl cellulose; and dispersed in the coating blend from about 60 to about 40 percent by weight of colloidal silica.

20. An ink jet paper in accordance with claim 16 wherein the coating blend is present in a thickness of from about 5 to about 25 microns.

21. An ink jet paper in accordance with claim 17 wherein the coating blend is present in a thickness of from about 5 to about 25 microns.

22. An ink jet transparency comprising a supporting substrate and a coating consisting essentially of a blend of poly(ethylene oxide), carboxymethyl cellulose, and a component selected from the group consisting of (1) hydroxypropyl cellulose; (2) vinylmethyl ether/maleic acid copolymer; (3) carbolymethyl hydroxyethyl cellulose; (4) hydroxyethyl cellulose; (5) acrylamide/acrylic acid copolymer; (6) cellulose sulfate; (7) poly(2-acrylamido-2-methyl propane sulfonic acid); (8) poly(-vinyl alcohol); (9) poly(vinyl pyrrolidone); and (10) hydroxypropylmethyl cellulose.

23. An ink jet transparency in accordance with claim 22 wherein the coating consists essentially of a blend of poly(ethylene oxide), carboxymethyl cellulose, and a component selected from the group consisting of hydroxypropyl cellulose and hydroxypropylmethyl cellulose.

24. An ink jet transparency in accordance with claim 22 wherein the coating consists essentially of a blend of poly(ethylene oxide), carboxymethyl cellulose, and hydroxypropyl cellulose.

25. An ink jet transparency in accordance with claim 22 wherein in coating consists essentially of a blend of poly(ethylene oxide), carboxymethyl cellulose, and hydroxypropylmethyl cellulose.

* * * * *